US010104981B2

(12) United States Patent
Nekhala

(10) Patent No.: US 10,104,981 B2
(45) Date of Patent: Oct. 23, 2018

(54) FLEXIBLE MATERIAL TIGHTENER

(71) Applicant: Jack Nekhala, Linden, NJ (US)

(72) Inventor: Jack Nekhala, Linden, NJ (US)

( * ) Notice: Subject to any disclaimer, the term of this patent is extended or adjusted under 35 U.S.C. 154(b) by 0 days.

(21) Appl. No.: 15/298,341

(22) Filed: Oct. 20, 2016

(65) Prior Publication Data

US 2017/0035210 A1 Feb. 9, 2017

Related U.S. Application Data

(63) Continuation-in-part of application No. 15/056,442, filed on Feb. 29, 2016, now Pat. No. 9,492,022.

(51) Int. Cl.

| | |
|---|---|
| ***A47C 21/02*** | (2006.01) |
| ***A47G 21/16*** | (2006.01) |
| ***A47G 9/02*** | (2006.01) |
| ***E04H 4/10*** | (2006.01) |
| ***A47G 11/00*** | (2006.01) |
| ***D06F 83/00*** | (2006.01) |
| *D06F 81/14* | (2006.01) |

(52) U.S. Cl.

CPC ..... *A47C 21/022* (2013.01); *A47G 9/0246* (2013.01); *A47G 11/004* (2013.01); *A47G 21/167* (2013.01); *D06F 83/00* (2013.01); *E04H 4/10* (2013.01); *D06F 81/14* (2013.01)

(58) Field of Classification Search

CPC ..... A47G 9/0246; A47G 9/02; A47G 9/0238; A47G 9/0292; A47G 9/04

See application file for complete search history.

(56) References Cited

U.S. PATENT DOCUMENTS

| | | | | | |
|---|---|---|---|---|---|
| 2,435,082 | A * | 1/1948 | Huber | A47C 21/022 | 210/479 |
| 2,930,053 | A * | 3/1960 | Nowels | A47C 21/022 | 5/212 |
| 4,727,608 | A * | 3/1988 | Joyce | A47G 9/0246 | 24/712 |
| 4,777,894 | A * | 10/1988 | Joyce | A47G 9/0246 | 112/475.06 |
| 4,937,904 | A * | 7/1990 | Ross | A47C 21/022 | 24/72.5 |
| 4,970,744 | A * | 11/1990 | Davis | A47G 9/0246 | 5/496 |
| 5,020,177 | A * | 6/1991 | Etherington | A47G 9/02 | 5/496 |
| 5,046,207 | A * | 9/1991 | Chamberlain | A47G 9/0246 | 5/496 |
| 5,046,222 | A * | 9/1991 | Byers | D06F 55/00 | 24/343 |

(Continued)

*Primary Examiner* — Eric J Kurilla

(74) *Attorney, Agent, or Firm* — Michael J. Feigin, Esq.; Feigin and Fridman

(57) ABSTRACT

A cord with an outer fabric covering over a sheath and draw string is used to secure a flexible sheet to a solid object, such as a mattress, table, pool, or ironing board. In some embodiments, the cord is a string lacking a sheath and draw string. The cord has a series of clips attached there-to by a second cord or by direct attachment. The clips are in turn removably attachable to edges of a sheet. One then tightens the draw string, reducing the length of the cord, and continues to do so until the sheet is pulled to a bottom side of an object. In this manner, the sheet ends are beneath the mattress and tightened thereto by the cord. The cord further snaps to itself, in embodiments of the disclosed technology, to form a closed loop around the bed.

14 Claims, 15 Drawing Sheets

(56) References Cited

U.S. PATENT DOCUMENTS 5,557,814 A * 9/1996 Cybulski ..... A47G 9/02 5/485
5,628,077 A * 5/1997 Briganti ..... A47G 9/0246 5/496
6,108,837 A * 8/2000 Knebel, III ..... A47C 21/022 24/457
6,199,247 B1 * 3/2001 Tsai ..... A47K 10/14 24/343
8,332,976 B1 * 12/2012 Goldwater ..... A47G 9/02 5/484
8,607,383 B2 * 12/2013 Briganti ..... A47G 9/0246 5/496
2002/0116763 A1 * 8/2002 Weir ..... A47G 9/0246 5/504.1
2003/0019037 A1 * 1/2003 Michaelis ..... A47G 9/02 5/497
2004/0060113 A1 * 4/2004 Lantagne ..... A47C 21/022 5/494
2008/0028522 A1 * 2/2008 Atwood ..... A47G 9/0246 5/496
2008/0155749 A1 * 7/2008 Stevens ..... A47G 9/0246 5/496
2008/0289104 A1 * 11/2008 Rowson ..... A47G 9/02 5/482
2009/0172881 A1 * 7/2009 Peterson ..... A47C 21/022 5/496
2012/0005867 A1 * 1/2012 Whaley ..... A47C 21/022 24/302
2012/0186013 A1 * 7/2012 Ponsi ..... A61G 7/001 5/81.1 R
2012/0324646 A1 * 12/2012 Briganti ..... A47G 9/0246 5/496
2014/0013510 A1 * 1/2014 Mcaleney ..... A47G 9/0246 5/496
2015/0096123 A1 * 4/2015 Whaley ..... A47C 21/022 5/496
2016/0007774 A1 * 1/2016 Kakabeeke ..... A47G 9/0246 5/496
2016/0058214 A1 * 3/2016 Preston ..... A47G 9/0238 5/496
2016/0174738 A1 * 6/2016 Nekhala ..... A47G 9/0246 5/496

* cited by examiner

FLEXIBLE MATERIAL TIGHTENER

FIELD OF THE DISCLOSED TECHNOLOGY

The disclosed technology relates generally to coverings for objects and more specifically, to device and methods for tightening sheets and the like onto objects.

BACKGROUND OF THE DISCLOSED TECHNOLOGY

There are generally speaking, two different types of bed sheets commonly purveyed in the market. There are "fitted sheets," which have a built in elastic or other structure to hold a sheet to a bed, and there are "unfitted sheets," which comprise a layer of fabric to be tucked under the corners of a mattress, or the like. Fitted sheets typically follow the contours of a specific bed more than do unfitted sheets. The former is designed to contract around the contours of a mattress, while the latter is typically tucked under the mattress as tightly as possible. In both cases, one usually must lift at least the corners of the bed and tuck the fabric between a base of a bed and a mattress. This can be strenuous work and is difficult for those of little strength, such as the elderly or handicapped. Further, for hotels, hospitals, and the like, time spent by employees in making up beds is expensive.

What is needed in the art is a way to have a tightly fitting sheet around a bed which is simple to manufacture, inexpensive to procure, and which reduces the time spent in covering a bed with a sheet.

SUMMARY OF THE DISCLOSED TECHNOLOGY

An object of the disclosed technology is to secure a bed sheet, whether fitted or unfitted, to a mattress or bed. In a method of doing so, this is accomplished by covering a mattress or part of a bed with a fabric sheet by placing the fabric sheet of a top side of the mattress with at least some of the fabric sheet draped over at least one of a front, back, left and right side of the mattress. Then one wraps a continuous cord with draw string around each of the front, back, left, and said right side of the bed and connects the sheet to the cord via removably connectable cords. At least one such cord is adjacent to (closest to)/abutting each cardinal side of the bed or the equivalent. Then one pulls the draw string (further) out of the continuous cord, causing the cord to decrease in length until the fabric sheet covers (completely) the front, back, left, and right side of the bed.

In embodiments of the disclosed technology, one pulls until the cord is completely adjacent to (defined as "closed to, compared to other sides," where a "side" extends to all edges having at least a 30 degree, 45 degree, or 90 degree change in direction) a bottom side of the bed, the bottom side being opposite the top side. The step of pulling continues, in embodiments of the disclosed technology, until the fabric sheet itself covers at least a portion of the bottom side of the bed. In the step of "placing," the placing can be over each respective side of the bed (between the top and bottom sides).

The cord has an outer fabric layer covering an elastic layer which, in turn, covers a hollow portal, in embodiments of the disclosed technology. The draw string can run a length of the hollow portal and exit from extreme ends thereof.

The removably connectable cords each have, in embodiments of the disclosed technology, one end with a removable clip, which is attached to the fabric sheet in the step of connecting. Another end can further be removably connectable or connected to the cord. The removably connectable cords, in embodiments of the disclosed technology, can each have one end with a removable clip, which is attached to the fabric sheet in the step of connecting, and another end which is fixedly and permanently connected to the cord.

In embodiments, a further step of connecting opposite ends of the cord to each other via a fastening mechanism before the step of pulling is also claimed.

A kit for covering a bed with a fabric sheet includes an elastic cord with draw string extending within an elastic layer and fabric layer of the cord, and a plurality of removable cords attached perpendicularly to the elastic cord, each having a connector at at least one end. The elastic cord with draw string is sized to fit around sides of a pre-determined sized bed in a first condition, and sized to be smaller than the sides of the pre-determined sized bed in a second condition. Pulling the draw string out of the elastic cord causes the elastic cord to change in size from the first condition to the second condition.

The plurality of removable cords, in some embodiments, each have clamps which removably attach to other objects, including one at a first end removably attached to the elastic cord, and a second, at a second opposite end from the first end, removably attached to the fabric sheet. In other embodiments, the plurality of removable cords each has clamps which removably attach, including one at a first end removably attached to the fabric sheet, and the clamp further having a permanent connection to the elastic cord at a second opposite end thereof.

The elastic cord can have fasteners on extreme ends thereof which fasten to each other. Each of the plurality of removable cords can have a snap fastener. The snap fasteners can be fixedly attached or removably attached to the elastic cord. The elastic cord itself can be fixedly attached in a queen size, full size, or twin size, Olympic queen, king, or California king size ring structure. In other embodiments, the elastic cord is removably attachable/detachable at a portion thereof.

"Substantially" and "substantially shown," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a or b," "b."

DETAILED DESCRIPTION OF EMBODIMENTS OF THE DISCLOSED TECHNOLOGY

The technology disclosed includes a cord with an outer fabric covering over a sheath and draw string. The sheath and/or fabric and/or cord, in general, can be of elastic material (defined as stretchable and compressible from a first length to at least a length double the first length, without losing structural integrity). The cord has a series of clips attached there-to (removably or irremovably) by a second cord or by direct attachment. The clips are in turn removably attachable to edges of a sheet while the sheet is unconnected to, partially on, or fully on the surface and/or sides of the mattress. "Removable," for purposes of this disclosure, is defined as "able to repeatedly attach and detach more than 30 times without losing structural integrity or the ability to continue to attach and detach." Similarly, "irremovable" is defined as "unable to detach without causing destruction to at least some of the materials being detached, such as by cutting, tearing, or removing stitching." One then tightens the draw string, reducing the length of the cord, and continues to do so until the sheet is pulled to a bottom side of the mattress. In this manner, the sheet ends are beneath the mattress and tightened thereto by the cord.

Embodiments of the disclosed technology will become clearer in view of the following discussion of the figures.

Figure 1:
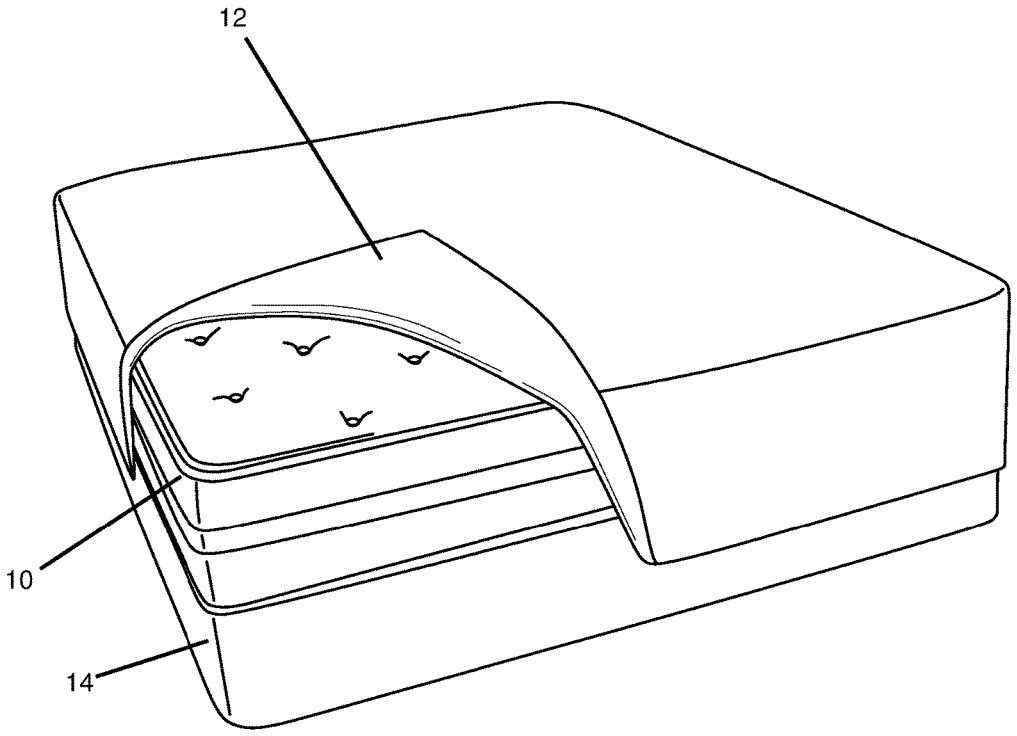
FIG. 1 shows a top perspective view of a bed with sheet, in an embodiment of the disclosed technology.

FIG. 1 shows a top perspective view of a bed with sheet, in an embodiment of the disclosed technology. Here, the mattress 10 has right, left, front, and back sides, as well as top and bottom sides. A rectangular mattress is shown, though it should be understood that a mattress of any size or shape is within the scope of the disclosed technology. The sheet 12 shown is an unfitted sheet draping over at least some of the sides of the mattress 10. The mattress 10 rests on a bed base 14, such as a box spring or other support for the mattress situated between the mattress and the floor.

Figure 2:
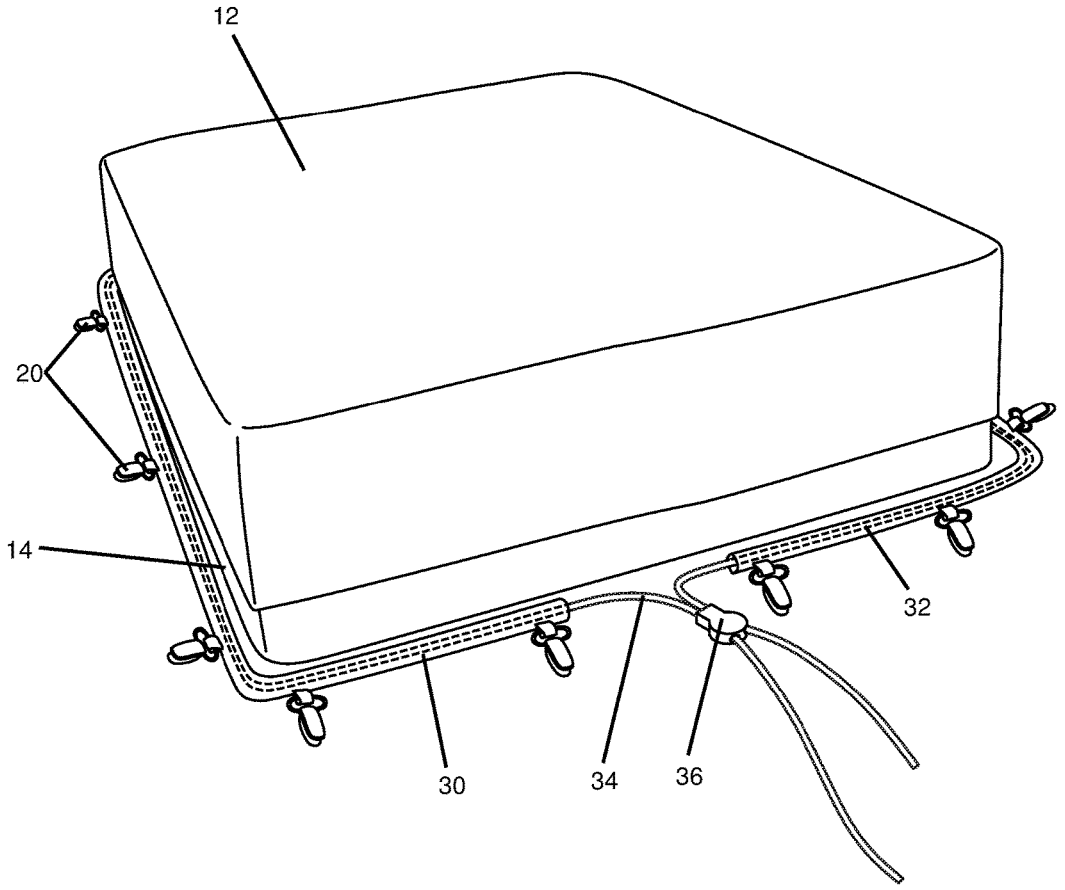
FIG. 2 shows the bed with sheet of FIG. 1, with a draw string cord placed around the perimeter of the bed.

FIG. 2 shows the bed with sheet of FIG. 1, with a draw string cord placed around the perimeter of the bed. The mattress is hidden from view below the sheet 12, which is shown falling on each respective side of the bed. That is, the sheet is placed primarily (mostly) over the top side, with portions hanging down over the left, right, front, and back sides of the mattress situated atop bed base 14. The draw string 34 is shown passing through the portal 32 in the cord 30. The portal runs the length of, and extends through, the cord 30. The cord 30 can be attached at a meeting point or juncture at a lock connector 36 which frictionally grasps the cord and allows one to pull the cord 30 there-through in one or both directions (decreasing or increasing the length of cord passed through the juncture 36), but in a resting position (defined as, "without human forces or human-directed forces acting thereon"), retaining a present position along the cord 30. The cord 30, the draw string 34, and/or the sheath/portal 32 can each be elastic. In this manner, the cord 30 decreases from a fully stretched out length to a lesser length from end to end while in a resting position. Thus, one stretches the cord to fit around the sides of a mattress and then decreases it in length to snugly fit and remain frictionally attached at the sides of the mattress. The clips 20 will be discussed in detail with reference to FIG. 3.

Figure 3:
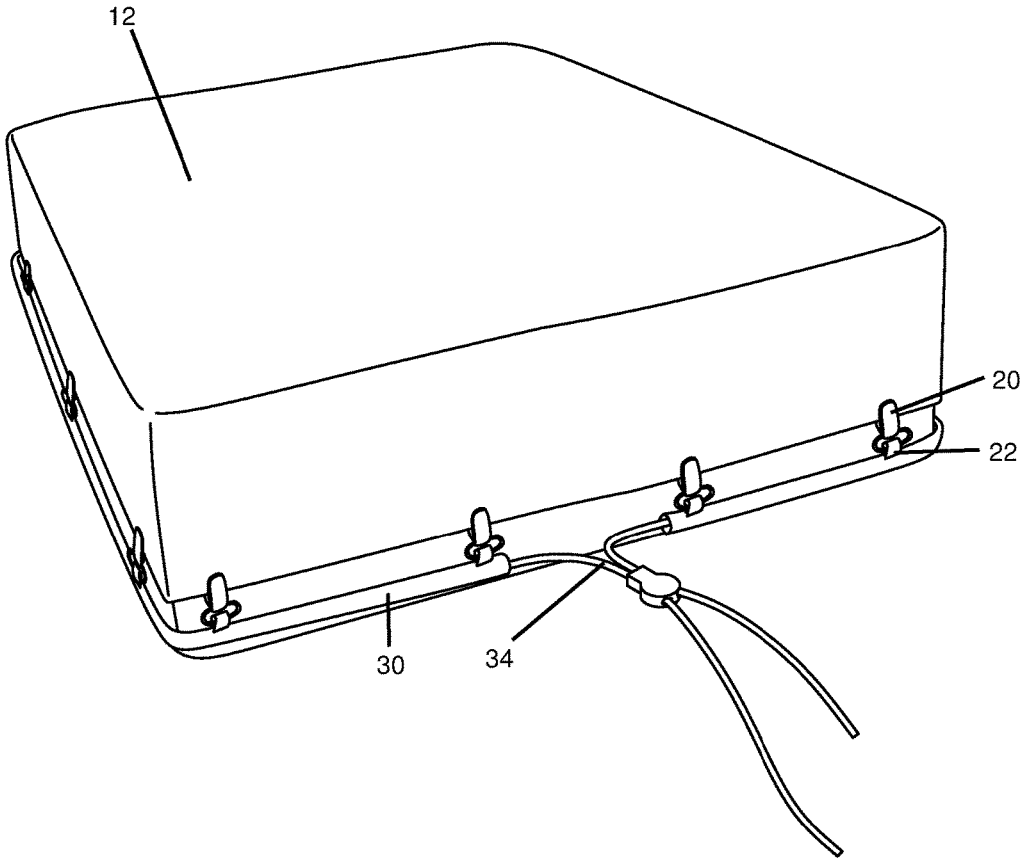
FIG. 3 shows the bed with sheet of the prior figures, with the draw string cord attached to the sheet.

FIG. 3 shows the bed with sheet of the prior figures, with the draw string cord attached to the sheet. Here, note that the clips 20 are on each side (top, left, right, bottom) of the mattress, with at least one per side. The opposite perspective view of the mattress and clips is a mirror image of what is shown, with the exception of the portion where the two ends of the cord 34 come together. In the opposite perspective view, the cord 30 is continuous without an opening in the sheath, in embodiments of the disclosed technology. The clips 20 have a length of fabric, elastic material, and/or elongated members, which are fixedly and/or irreversibly attached to the length of cord 30. In other embodiments, the clips 20 are detachable from the cord 30, such as by way of a removable clip or snap connector. In any case, the clips 20 are removably attached to the bed sheet 12 on each side, and the draw string 34 is ready to be tightened.

Figure 4:
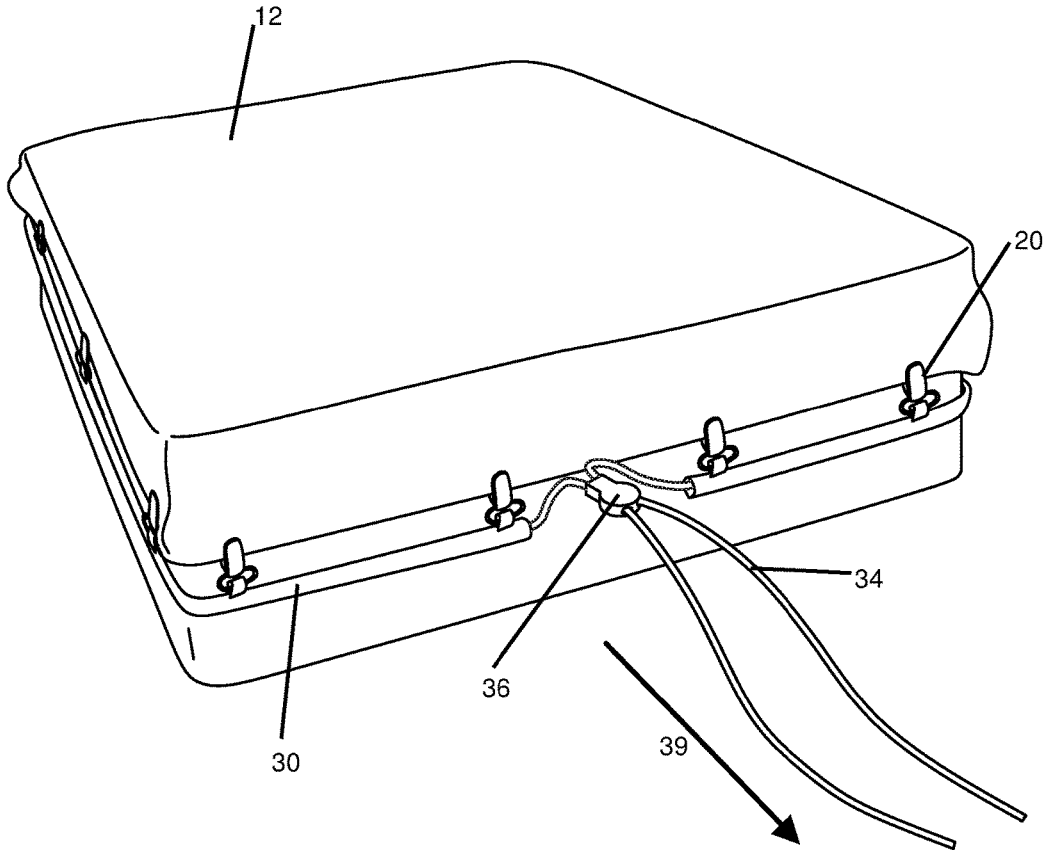
FIG. 4 shows the bed with sheet of FIG. 3, with the draw string being tightened.

FIG. 4 shows the bed with sheet of FIG. 3, with the draw string being tightened. The draw string 34 is tightened by pushing the lock connector 36 closer to the bed while pulling the ends of the string away from the mattress in the direction 39 shown in the figure. This causes the cord 30 to decrease in length as the draw string 34 is pulled out there-from. The direction 39 comprises also a downward vector, in embodiments of the disclosed technology. That is, in addition to being pulled in a direction directly away from the side of the bed, it is pulled down towards the floor on which the mattress 10 rests, at least slightly. Defining zero degrees as a pull directly horizontal and away from (perpendicular to) the side of the mattress 10, the downward pull is in a direction of −5, −15, −25, −30, or −45 degrees with respect thereto.

It should further be understood that the sheet 12 can be either a fitted or a non-fitted sheet, in different embodiments of the disclosed technology. When using a fitted sheet, one places the fitted sheet in a manner such that its elastic holds the sheet to each side of the mattress, as shown in FIG. 4. This can be covering half of each side. One then pulls the draw string 34 in the direction 39, as described in the preceding paragraph, and the fitted sheet (or non-fitted sheet) moves downward to cover the entire sides of the bed, and then at least a portion of the bottom of the mattress.

Figure 5:
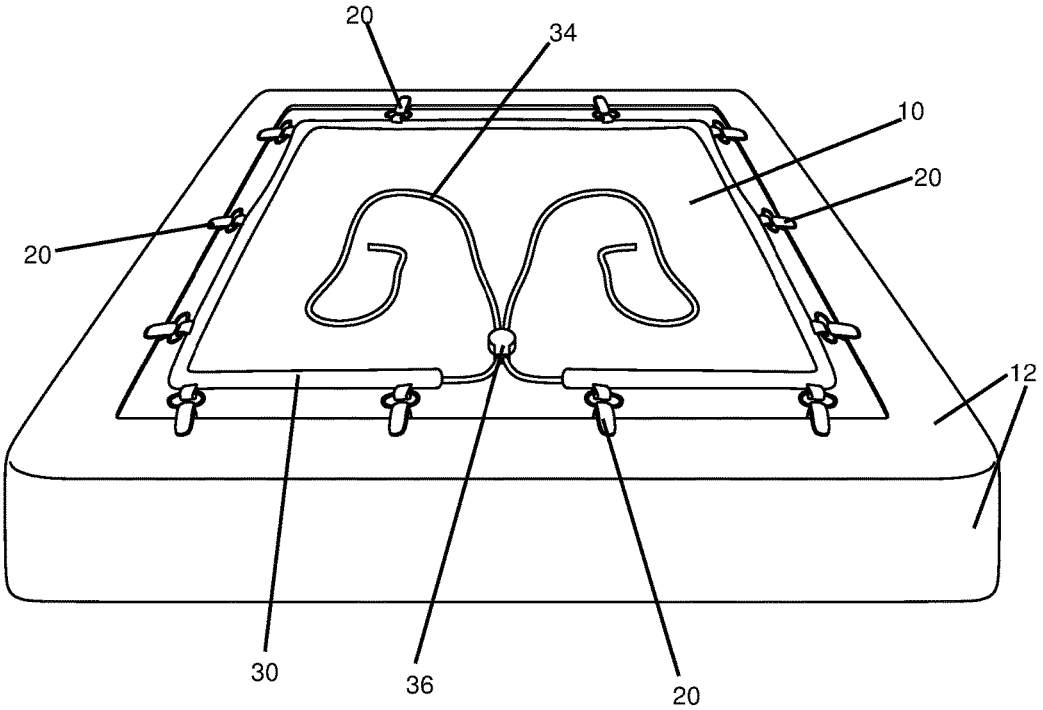
FIG. 5 shows a bottom perspective view of the bed with tightened sheet and draw string, in an embodiment of the disclosed technology.

FIG. 5 shows a bottom perspective view of the bed with tightened sheet and draw string, in an embodiment of the disclosed technology. The sheet 12 has been pulled over the entirety of the sides of the mattress 10, as well as at least a portion of the bottom of the mattress adjacent to (defined as "closest to") each side thereof. The clips 20 remain attached to the sheet 12 as well as to the cord 30.

Figure 6:
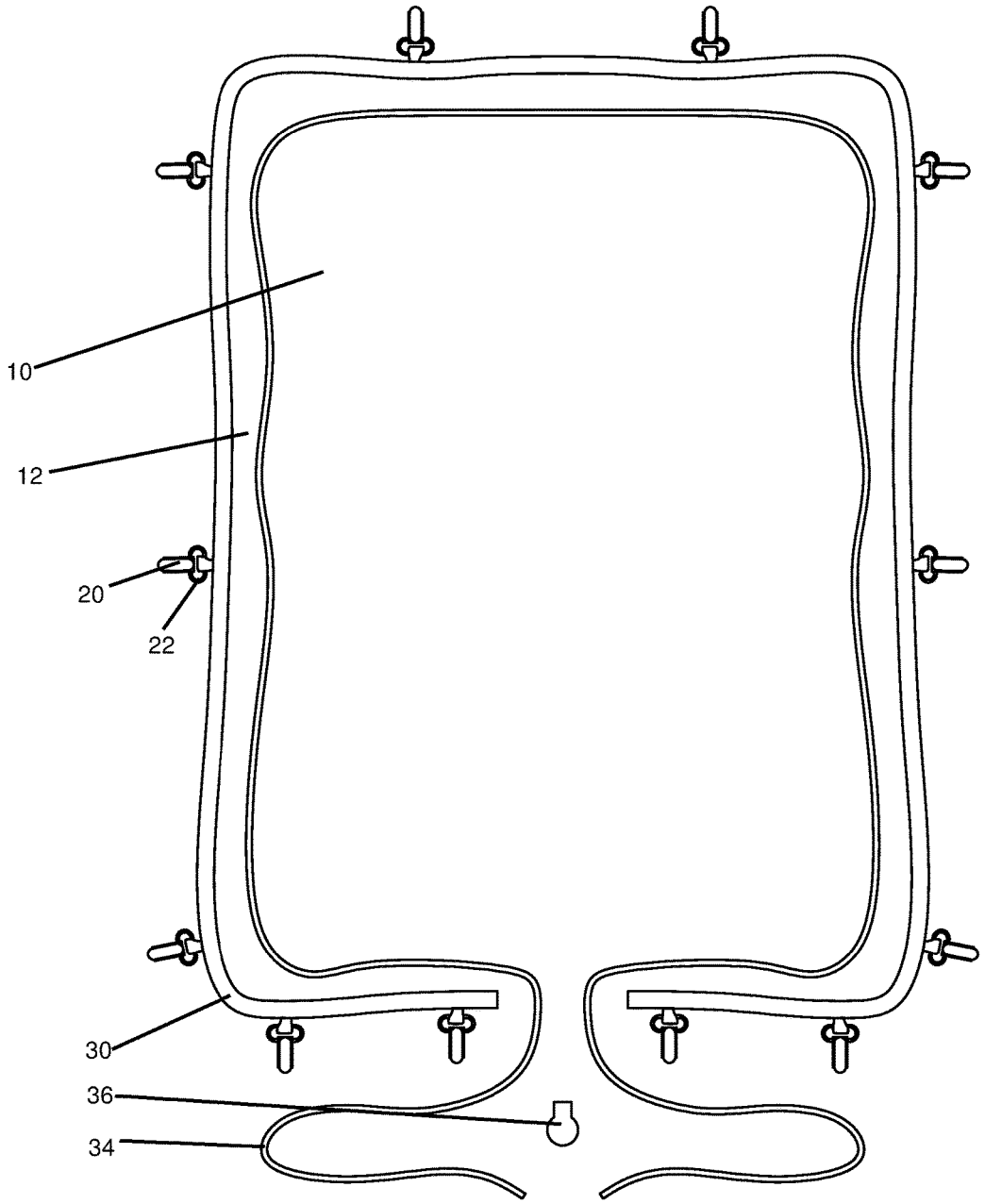
FIG. 6 shows the separate items used with embodiments of the disclosed technology.

FIG. 6 shows the separate items used with embodiments of the disclosed technology. Here, one sees the draw string 34 in its entirety, its length being greater than that of the cord 30 into which it fits. The clips 20 are attached removably or irremovably via material 22 to the cord 30.

Figure 7:
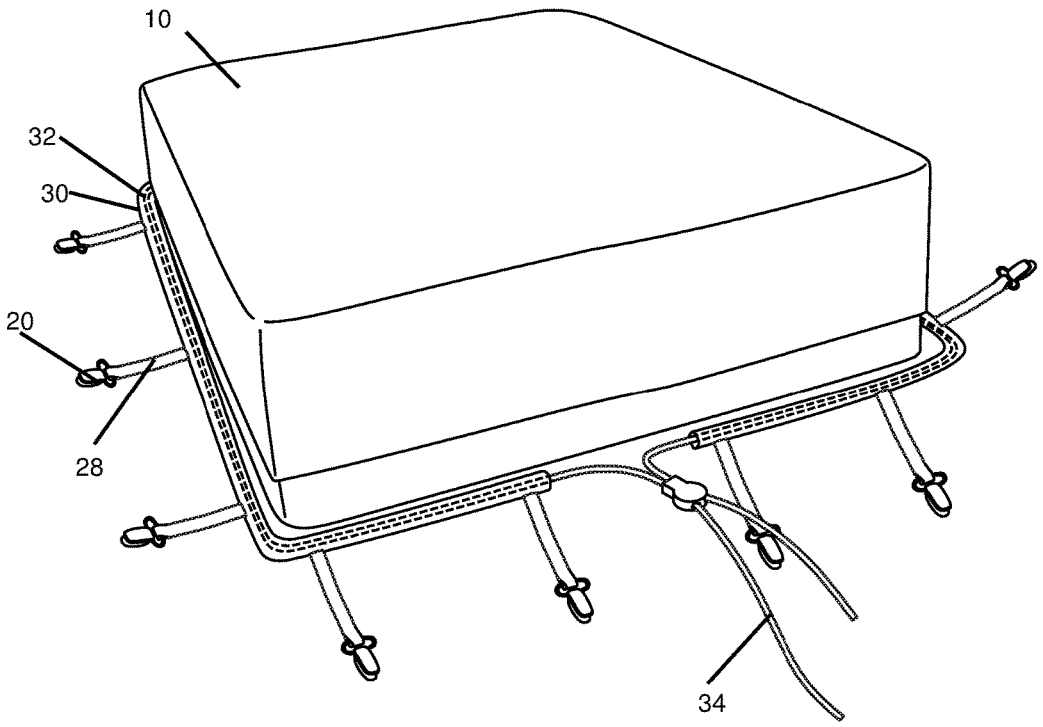
FIG. 7 shows an alternative embodiment of the string cord with cords attached thereto, in an embodiment of the disclosed technology.

FIG. 7 shows an alternative embodiment of the string cord with cords attached thereto, in an embodiment of the disclosed technology. Here, the clips 20 are connected to the cord 30 via a connecting region or further cord 28. The cord 28 shown is irremovably connected to the cord 30.

Figure 8:
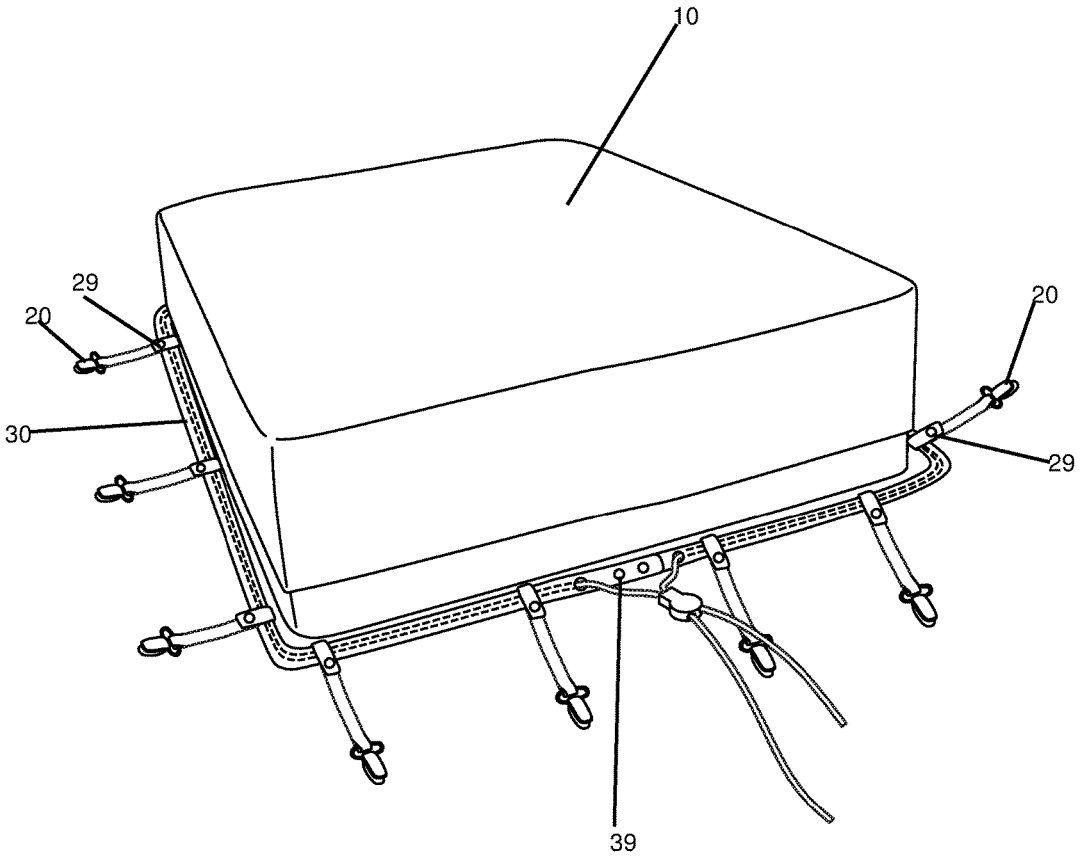
FIG. 8 shows a second alternative embodiment of the string cord with cords snapped thereto, in an embodiment of the disclosed technology.

FIG. 8 shows a second alternative embodiment of the string cord with cords snapped thereto, in an embodiment of the disclosed technology. Here, snaps 29 connect the clips 20 to the cord 30. The cord 30 can further be fastened to itself via snaps 39. This is readily seen when compared to the version shown in FIG. 7. In FIG. 7, note that the inner string 34 exits from ends of the cord 30. In the version shown in FIG. 8, the cord itself snaps together, forming a complete closed loop around the bed 12, under the sheet 10. The string 34, instead, exits from portals in the cord. This allows for a more aesthetically pleasing and, in some cases, structurally sound, configuration.

Figure 9:
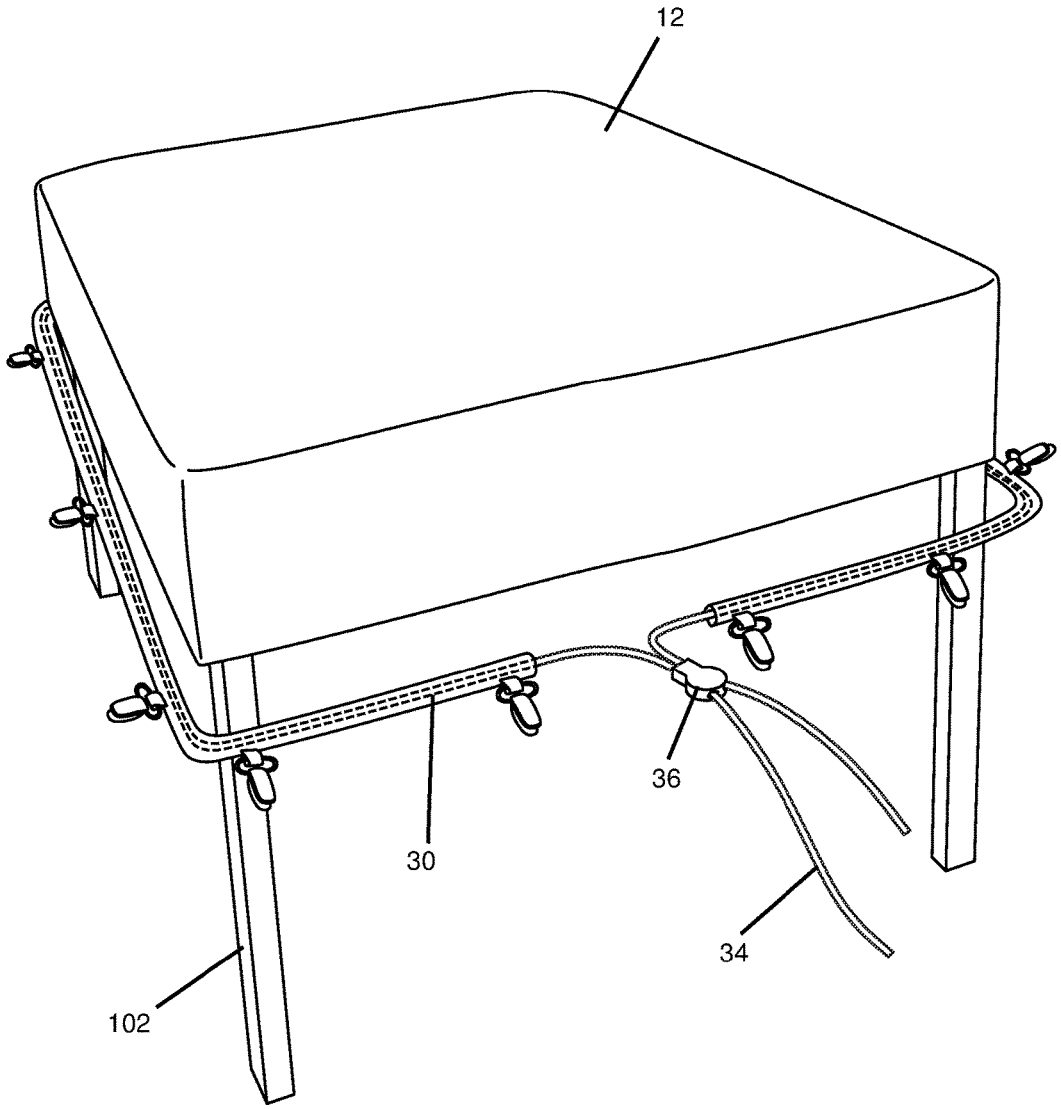
FIG. 9 shows a table with sheet of FIG. 1, with a draw string cord placed around the perimeter of the table.

FIG. 9 shows a table with sheet of FIG. 1, with a draw string cord placed around the perimeter of the table. Here, the devices and embodiments described above with reference to a bed and bed sheet apply for the table 102. The table has a top side, bottom side opposite the top side, and legs which extend from a top portion of the table, downwards. A fabric sheet 12, in this case, a table cloth, is draped over the top side of the table 102 with edges hanging down on the sides. One then attaches the cord 30, as described above, and tightens the cord using a cord lock 36 to pull the draw string 34 out from the sheath. This tightens the string around the sheet 12 and pulls it down. It should further be understood that in embodiments, the fabric sheet can instead be a plastic sheet or any other type of flexible and sheet-line material.

"Sheet-like" is defined as flexible, elongated, and adapted to cover another item such as a table cloth, fabric cover, pool cover, and so forth. A "cord lock" is defined as a device with two portals through which a string or rope can pass through each portal, the device having a mechanism to selectively allow the string or rope to move through the portal or portals with one or more of the following conditions: a) be locked into place, b) move only in one direction through each respective portal, c) and/or more in two directions through each respective portal. Thus, in embodiments it is desired to only allow the string or rope 32 to pass in one direction which causes the string or rope 32 to tighten around an object. When one wants to remove the flexible sheet 12, one might then unlock the cord lock 36 allowing the rope 32 to loosen and be removed from around an object.

Figure 10:
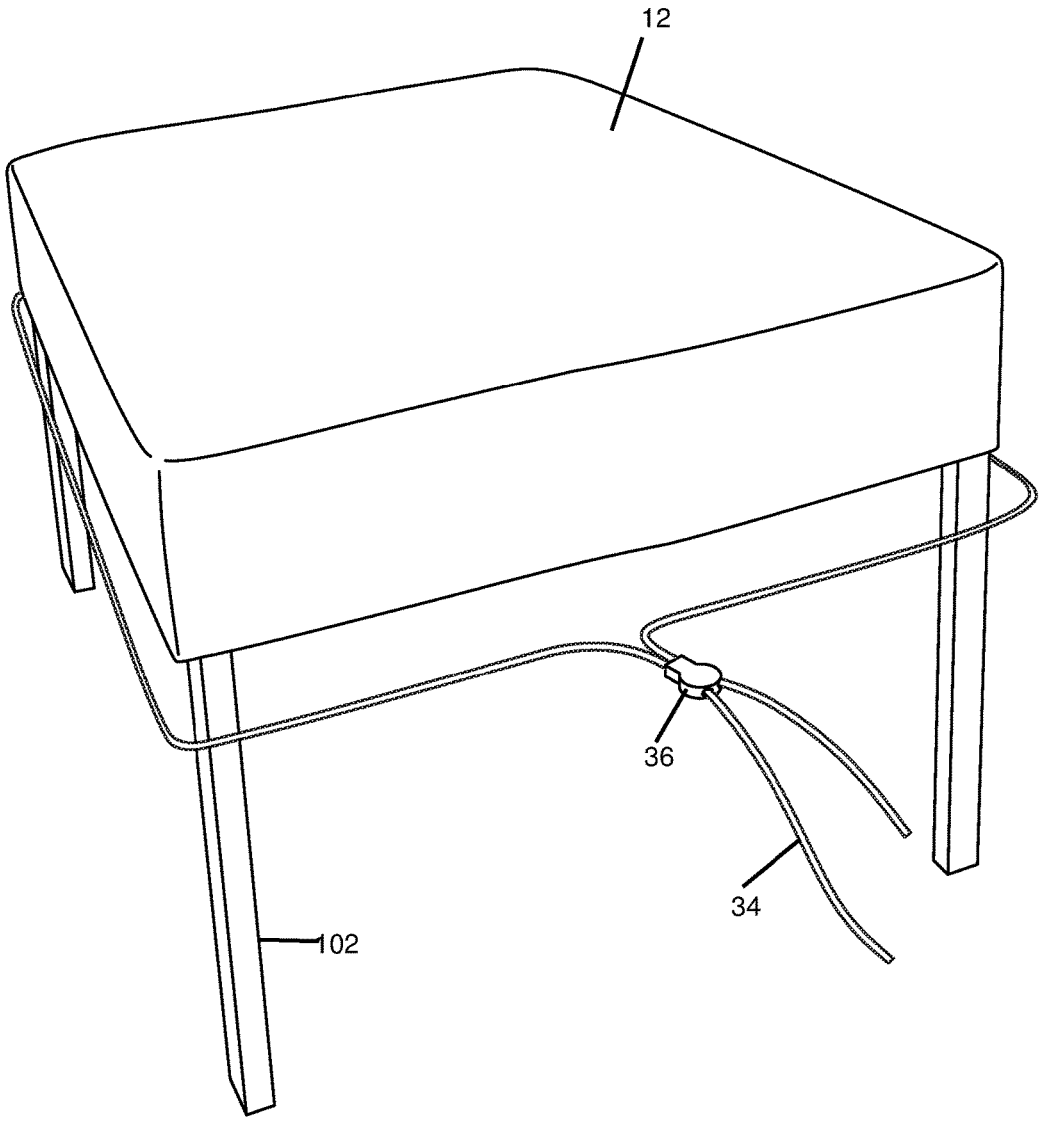
FIG. 10 shows the table with sheet of FIG. 9, with a string having a lock connector placed around the perimeter of the table.

FIG. 10 shows the table with sheet of FIG. 9, with a string having a lock connector placed around the perimeter of the table. Here, the difference is that the draw string 34 is now just a string or rope, as is understood in the art. The same method takes place, as described with reference to the above figures, except that the string 34 is not in a sheath or hollow cord 30. One attaches the string 34 to edges of the sheet 12 (whether the sheet 12 is a mattress sheet, table cloth, or other flexible sheet material described herein) and tightens the cord using the cord lock 36. One might exercise a slight downward directional force on the string 34 while doing this. The sheet 12 is pulled downwards (even without use of a sheath) as the string 34 is tightened and connectors which connect the string 34 to the sheet 12 effectuate the pulling down of the sheet around the sides of the object which the sheet covers. The object can be any shape and have any number of sides, including 1 side (round), 3 sides (triangular), 4 sides, 6 sides, and so forth. A "side" is further defined as a portion of an object between a top and bottom side which, in some embodiments, is separated from another side by an abrupt change in angle. The "top" and "bottom" sides refer to a directional vector compared to the direction of gravity or what the general public refers to there-as, such as with a table where the legs attach typically to a "bottom" side and a surface which one puts food on is typically called a "top" side.

Figure 10B:
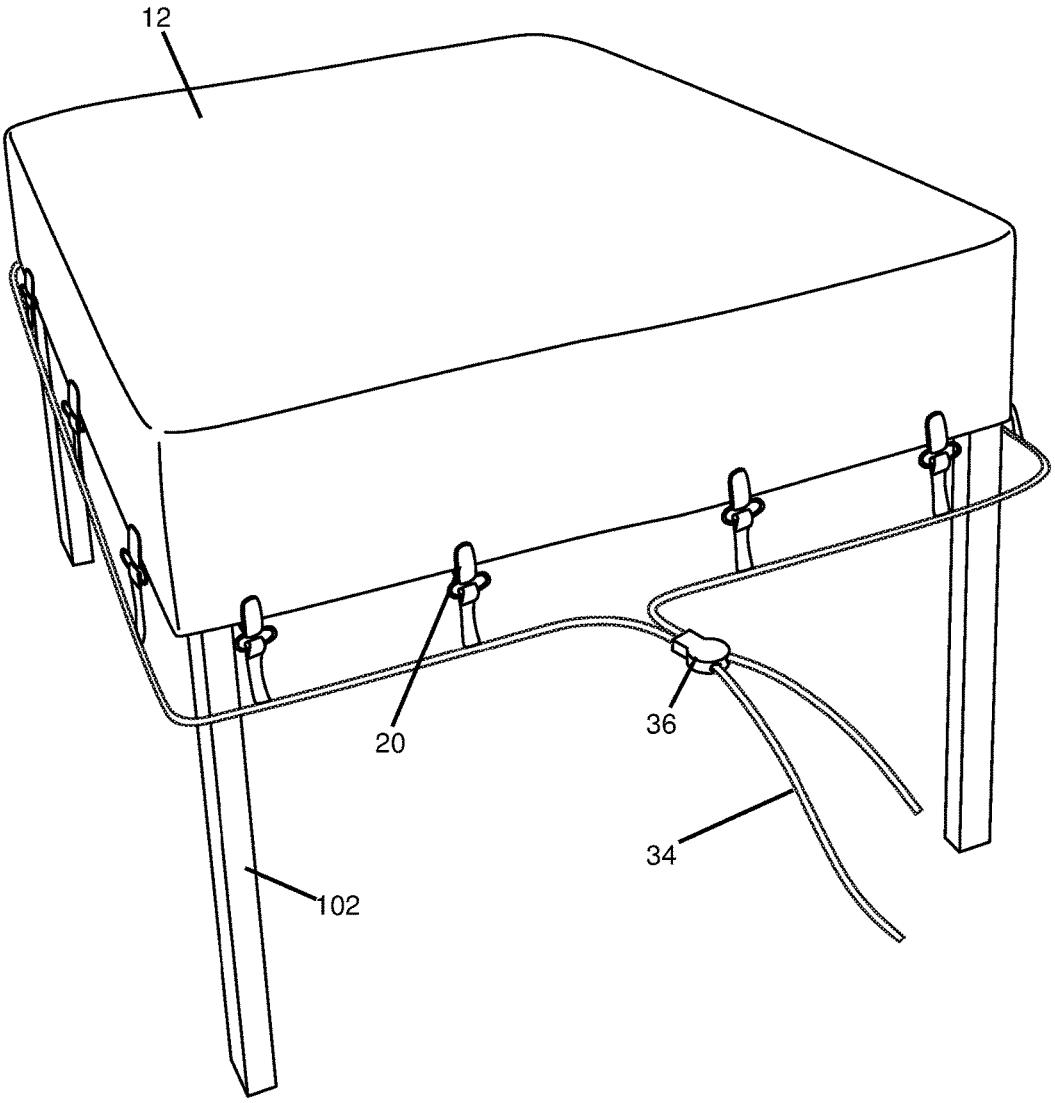
FIG. 10B shows the table with sheet of FIG. 10, with clips connecting the string to fabric sheet.

FIG. 10B shows the table with sheet of FIG. 10, with clips connecting the string to fabric sheet. Once the string or rope 34 is placed around the fabric sheet 12, clips 20 are attached between the string or rope 35 and the fabric sheet 12 on each of the sides of the sheet. When the string or rope 34 is tightened by way of the cord lock 36, the string pulls on the clips which, in turn, pulls the fabric sheet 12 downwards or in a direction having a downwards vector component (away from the top and most flat region of the sheet).

Figure 11:
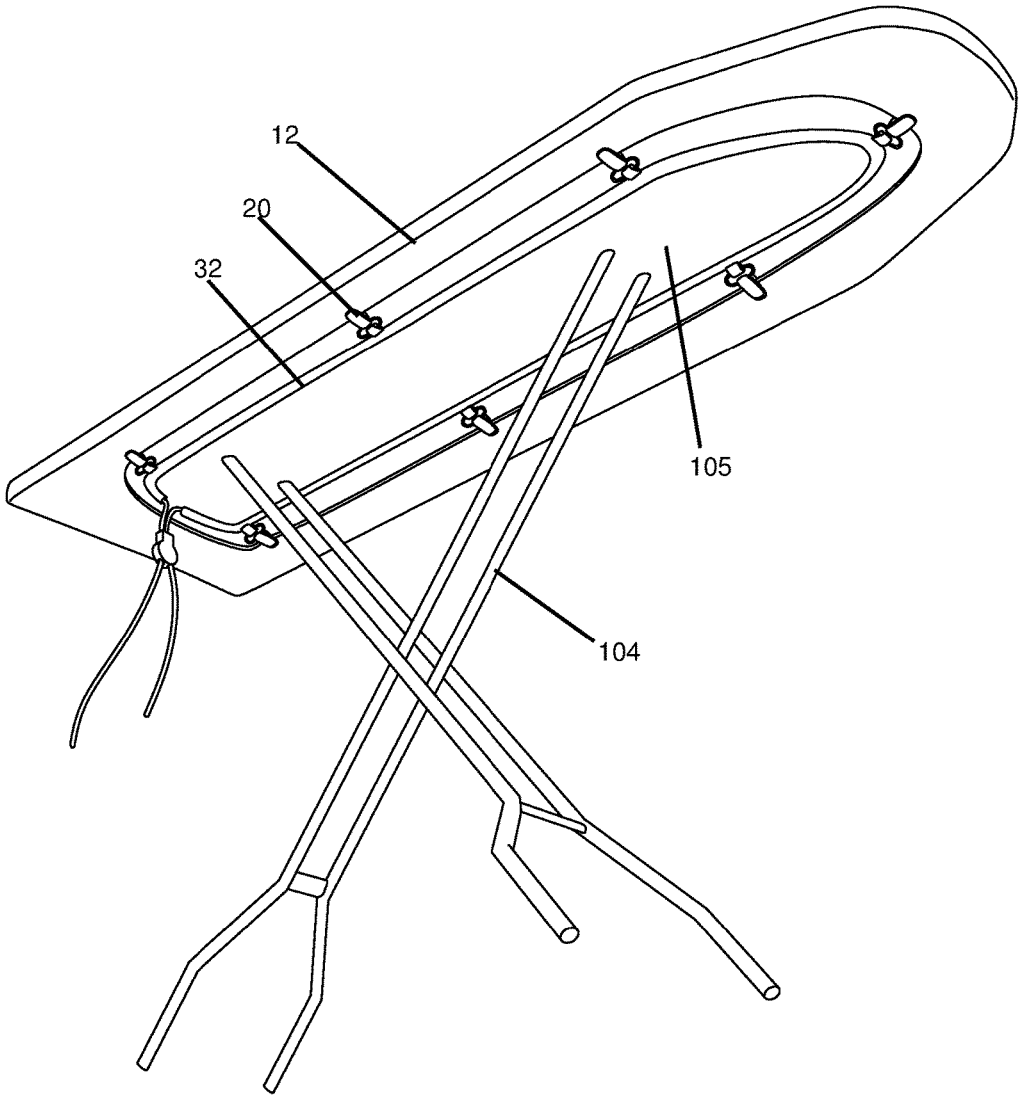
FIG. 11 shows a draw string being tightened around an ironing board, in embodiment of the disclosed technology.

FIG. 11 shows a draw string being tightened around an ironing board, in embodiment of the disclosed technology. In this embodiment, one can see the string 32 is attached or has fixed-thereon a plurality of clips 20 which are attached to a flexible sheet 12. In the same manner as above, one tightens the string 32 using a cord lock 36 to pull the cover/sheet 12 over the top of the ironing board 104, and in this embodiment, further under a bottom side 105 of the ironing board.

Figure 12:
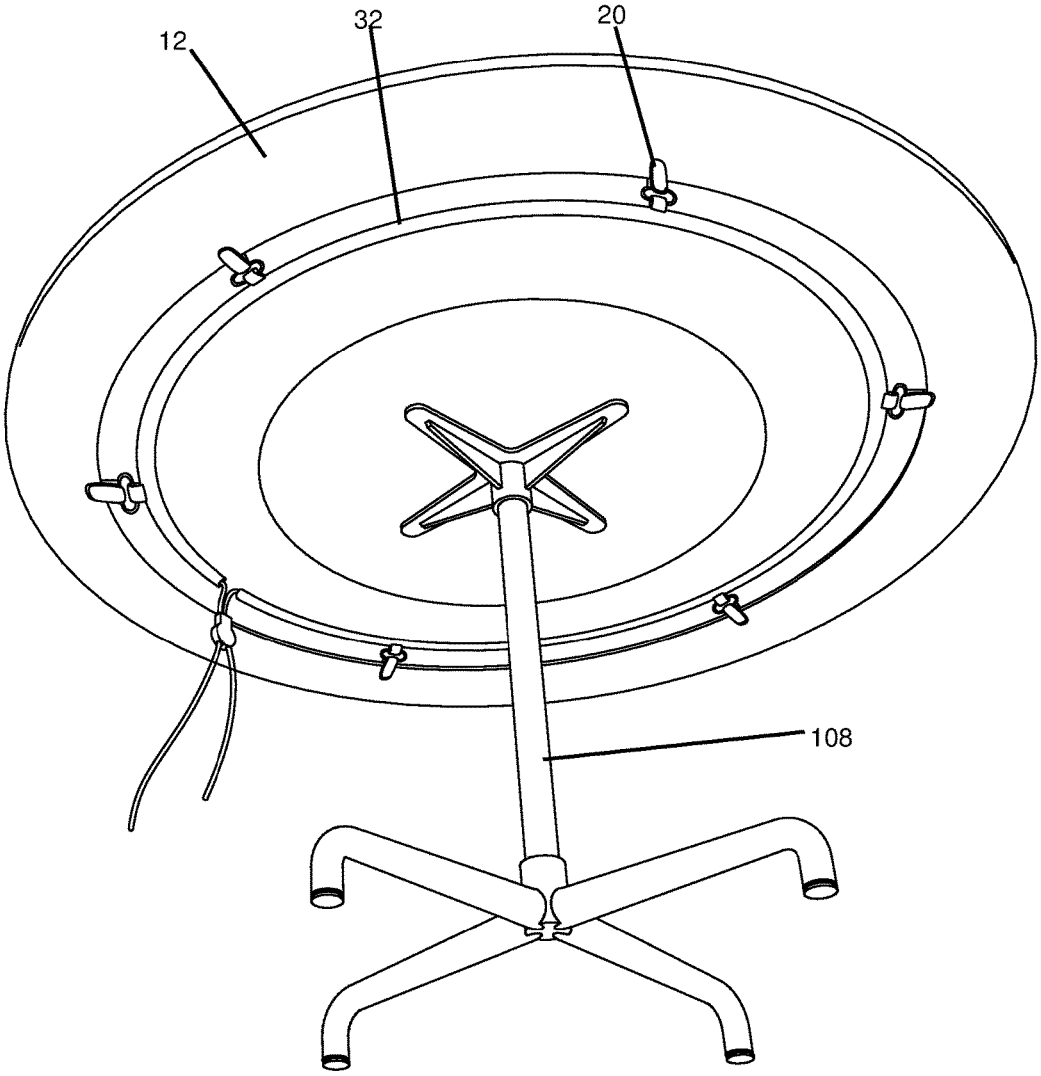
FIG. 12 shows a draw string being tightened around a round table, in embodiment of the disclosed technology.

FIG. 12 shows a draw string being tightened around a round table, in embodiment of the disclosed technology. Here the round table 108 has a single side between a top and bottom. The sheet 12 is placed over the top side and then hangs past the sides ("sides", when used alone, referring to what is between the top and bottom sides and connects them). In this embodiment, typically the sheet 12 is much larger than the combination of the top and sides of the item being covered so it drapes past the entirety of the top and sides. Tightening a string or draw string 32 within a sheath or without a sheath pulls the sheet 12 against the bottom side of the object (here, the table 108). Ultimately, the sheet 12 is tightened against the top side, sides, and bottom side of the table 108 or other object which the sheet is being tightened there-to.

Figure 13:
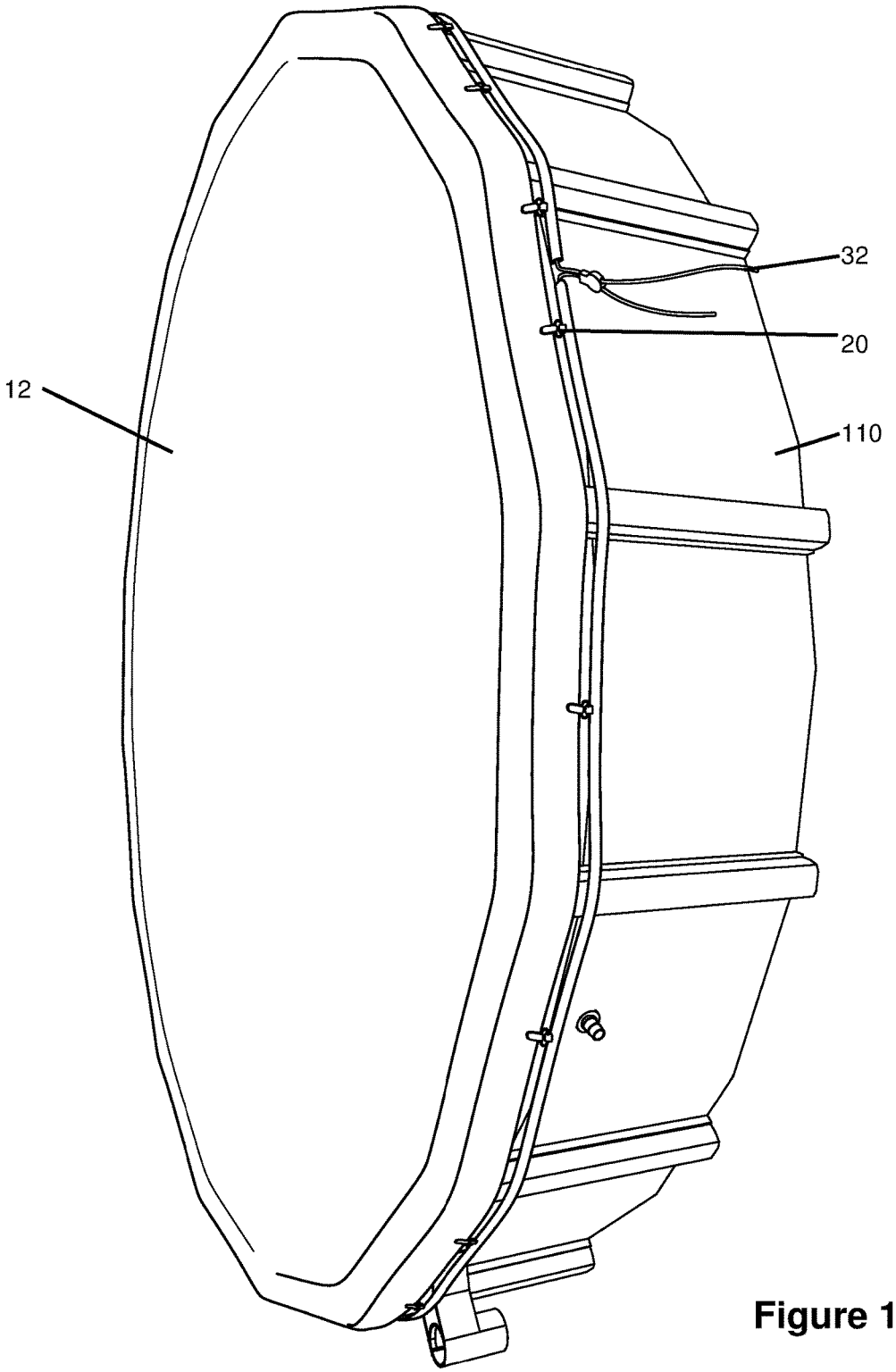
FIG. 13 shows a draw string being tightened around a pool, in embodiment of the disclosed technology.

FIG. 13 shows a draw string being tightened around a pool, in embodiment of the disclosed technology. In this embodiment, the sheet 12 is tightened around a pool 110 using a string 32 which is clipped by clips 20 to the sheet. One attaches the clips and string or cord to the sheet 12, tightens the string 32 using a cord lock, and thereby pulls the sheet 12 downwards, or, at least adds tension along the top side of the sheet 12.

Figure 14:
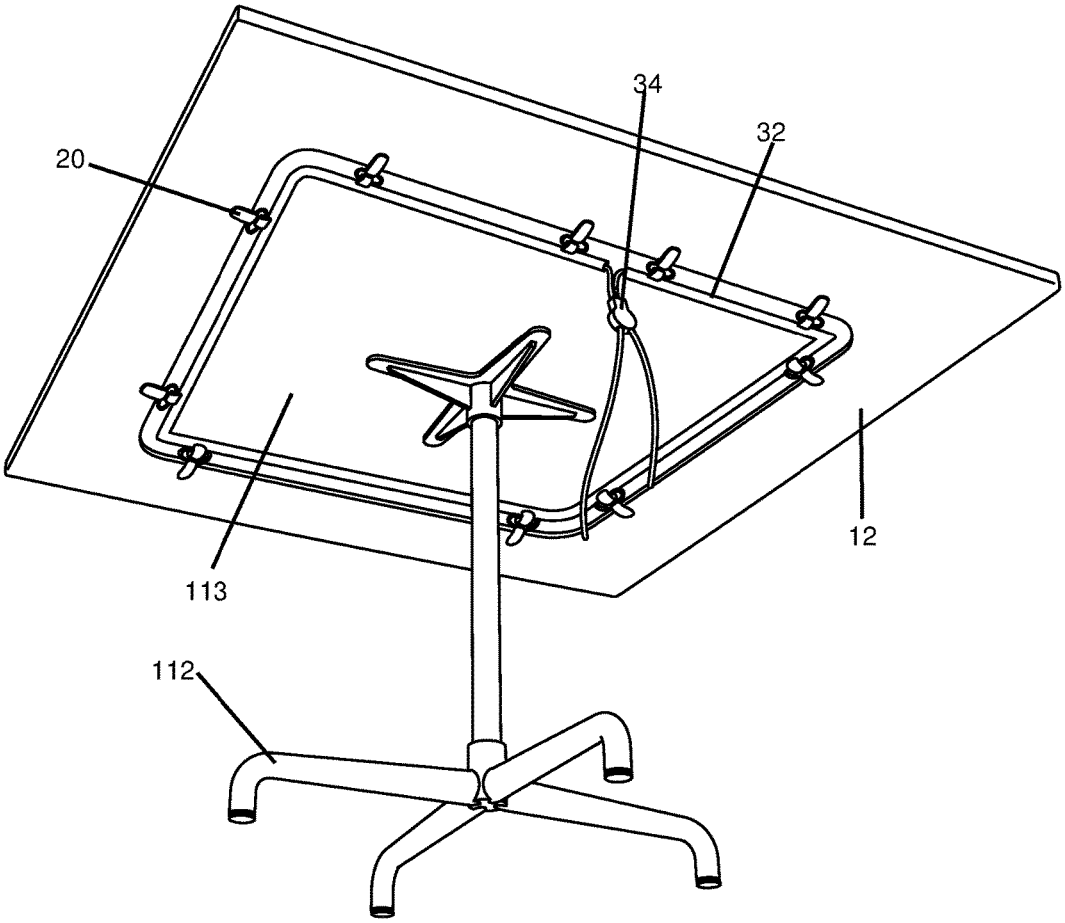
FIG. 14 shows a bottom perspective view of a table with tightened sheet and draw string, in an embodiment of the disclosed technology.

FIG. 14 shows a bottom perspective view of a table with tightened sheet and draw string, in an embodiment of the disclosed technology. Here, the square table 112 has a bottom side 113 on which a sheet 12 is pulled downwards to cover and touch each of a top side (opposite the bottom side 113), sides, and bottom side 113 and be tensioned (tight without or substantially without creases) to the respective top, sides, and bottom.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A method of covering an object with a flexible sheet, the object including a top and sides, the sides of the object being perpendicular to the top of the object, the method comprising the steps of:

placing said flexible sheet on said top of said object, with at least some of said flexible sheet draped over part or all of said sides of said object;

wrapping a string substantially or fully around said sides of said object, said string passing through a cord lock at two spaced-apart regions of said string;

connecting said flexible sheet to said string via a plurality of removable cords, with at least one cord of said plurality of removable cords being associated with each side of said sides of object; and pulling at least a portion of said string through said cord lock, causing said string to decrease in length such that said connected flexible sheet more tightly covers said top and said sides of said object.

2. The method of covering the object of claim 1, wherein said string is enclosed in a hollow cord and exits said hollow cord via a hollow portal; and upon further pulling said string out of said hollow portal said connected flexible sheet becomes more tightly covered around said top and said sides of said object.

3. The method of covering the object of claim 2, wherein said hollow cord comprises an outer fabric layer covering an elastic layer which, in turn, covers said hollow portal and said string runs a length of said hollow portal.

4. The method of covering the object of claim 3, wherein each cord of said plurality of removable cords comprises a removable clip at one end thereof, which is attached to said flexible sheet in said step of connecting and further comprises another end which is removably connectable to said string.

5. The method of covering the object of claim 3, wherein each cord of said plurality of removable cords comprises a removable clip at one end thereof, which is attached to said flexible sheet in said step of connecting and further comprises another end which is fixedly and permanently connected to said string.

6. The method of covering the object of claim 1, wherein said object is a mattress.

7. The method of covering the object of claim 1, wherein said object is a table or ironing board and said sides of said table are fully covered by said flexible sheet before said step of connecting.

8. The method of covering the object of claim 1, wherein said pulling is carried out until said flexible sheet abuts and tightly, without creases, is in parallel to a bottom side of said object, said bottom side being opposite said top side.

9. The method of covering the object of claim 8, wherein said step of pulling continues until said string is completely adjacent to a bottom side of said object.

10. The method of covering the object of claim 1, wherein said object is substantially circular and said sides are only one side.

11. The method of covering the object of claim 10, wherein said object is selected from the group consisting of a pool and a table.

12. The method of covering the object of claim 1, further comprising a step of connecting opposite ends of said string to each other via said cord lock, before said step of pulling.

13. The method of covering the object of claim 1, wherein, following said pulling, an entirety of said sides and at least some of a bottom side of said object are tautly covered by said flexible sheet.

14. The method of covering the object claim 1, wherein said step of connecting said flexible sheet to said string is carried out before said step of placing said flexible sheet on said top side of said object.

* * * * *